US010609765B2

(12) United States Patent
Johnson

(10) Patent No.: US 10,609,765 B2
(45) Date of Patent: Mar. 31, 2020

(54) ICE MELTING ASSEMBLY

(71) Applicant: Nathaniel Johnson, Marion, IN (US)

(72) Inventor: Nathaniel Johnson, Marion, IN (US)

( * ) Notice: Subject to any disclaimer, the term of this patent is extended or adjusted under 35 U.S.C. 154(b) by 186 days.

(21) Appl. No.: 15/602,188

(22) Filed: May 23, 2017

(65) Prior Publication Data

US 2018/0343703 A1 Nov. 29, 2018

(51) Int. Cl.
*H05B 1/02* (2006.01)

(52) U.S. Cl.
CPC ..... *H05B 1/0236* (2013.01)

(58) Field of Classification Search
CPC ..... H05B 3/0042; H05B 1/0236; H05B 37/0272; H05B 37/0281
USPC ..... 219/202, 203, 205, 528, 544, 549
See application file for complete search history.

(56) References Cited

U.S. PATENT DOCUMENTS 3,336,064 A 8/1967 Dzaack
4,676,918 A 6/1987 Toth et al.
D364,173 S 11/1995 Woods
5,573,686 A * 11/1996 Lavicska ..... B62D 25/161 219/202
6,237,861 B1 5/2001 Northrop et al.
2004/0262425 A1 12/2004 Sakai et al.
2005/0224271 A1 10/2005 Carr
2008/0296279 A1* 12/2008 Forrest ..... B62D 25/16 219/202
2014/0077707 A1* 3/2014 Restrepo ..... H05B 37/0272 315/158

FOREIGN PATENT DOCUMENTS

WO WO1999054153 10/1999

* cited by examiner

*Primary Examiner* — Phuong T Nguyen

(57) ABSTRACT

An ice melting assembly for inhibiting ice and snow from collecting in a wheel well includes a liner that is mounted in a wheel well of a vehicle. A heating element is positioned within the liner and the heating element is in thermal communication with the liner. A control is provided and the control is selectively manipulated. The control is electrically coupled to the heating element to turn the heating element on and off.

5 Claims, 4 Drawing Sheets

ICE MELTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to melting devices and more particularly pertains to a new melting device for inhibiting ice and snow from collecting in a wheel well.

BRIEF SUMMARY OF THE INVENTION

An embodiment of the disclosure meets the needs presented above by generally comprising a liner that is mounted in a wheel well of a vehicle. A heating element is positioned within the liner and the heating element is in thermal communication with the liner. A control is provided and the control is selectively manipulated. The control is electrically coupled to the heating element to turn the heating element on and off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
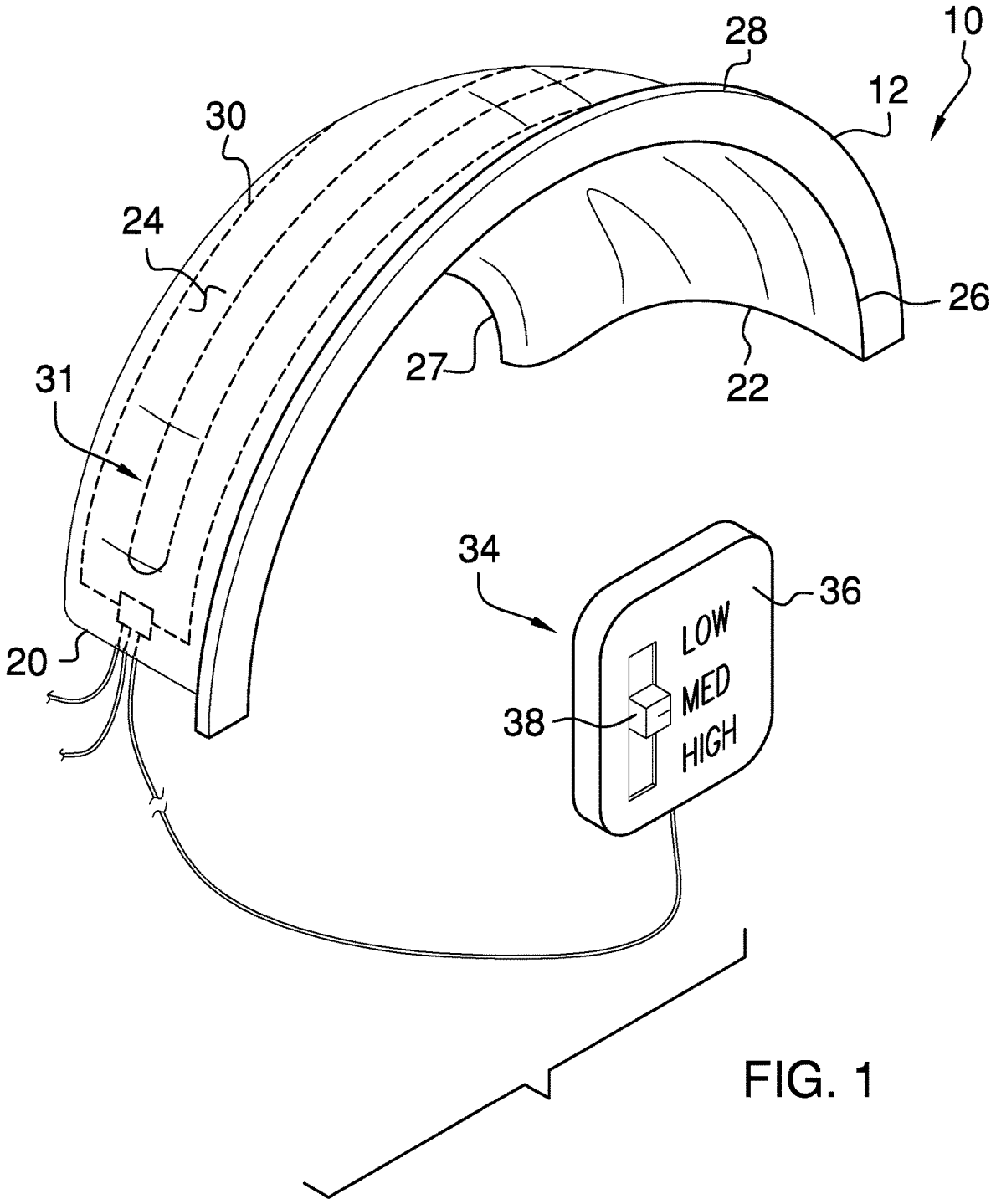
FIG. 1 is a phantom perspective view of an ice melting assembly according to an embodiment of the disclosure.
Figure 2:
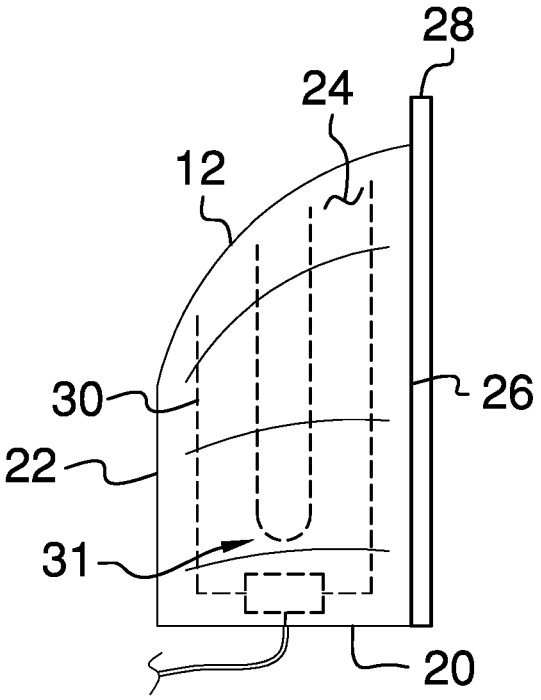
FIG. 2 is a right side phantom view of an embodiment of the disclosure.
Figure 3:
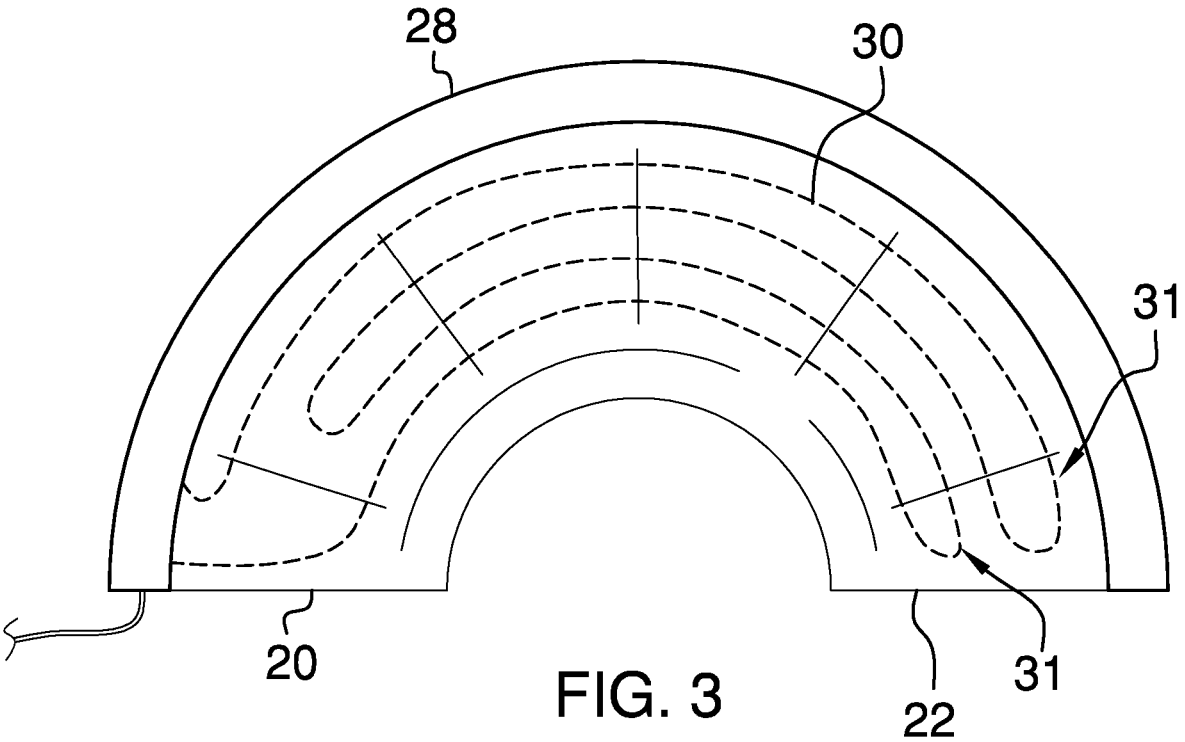
FIG. 3 is a front phantom view of an embodiment of the disclosure.
Figure 4:
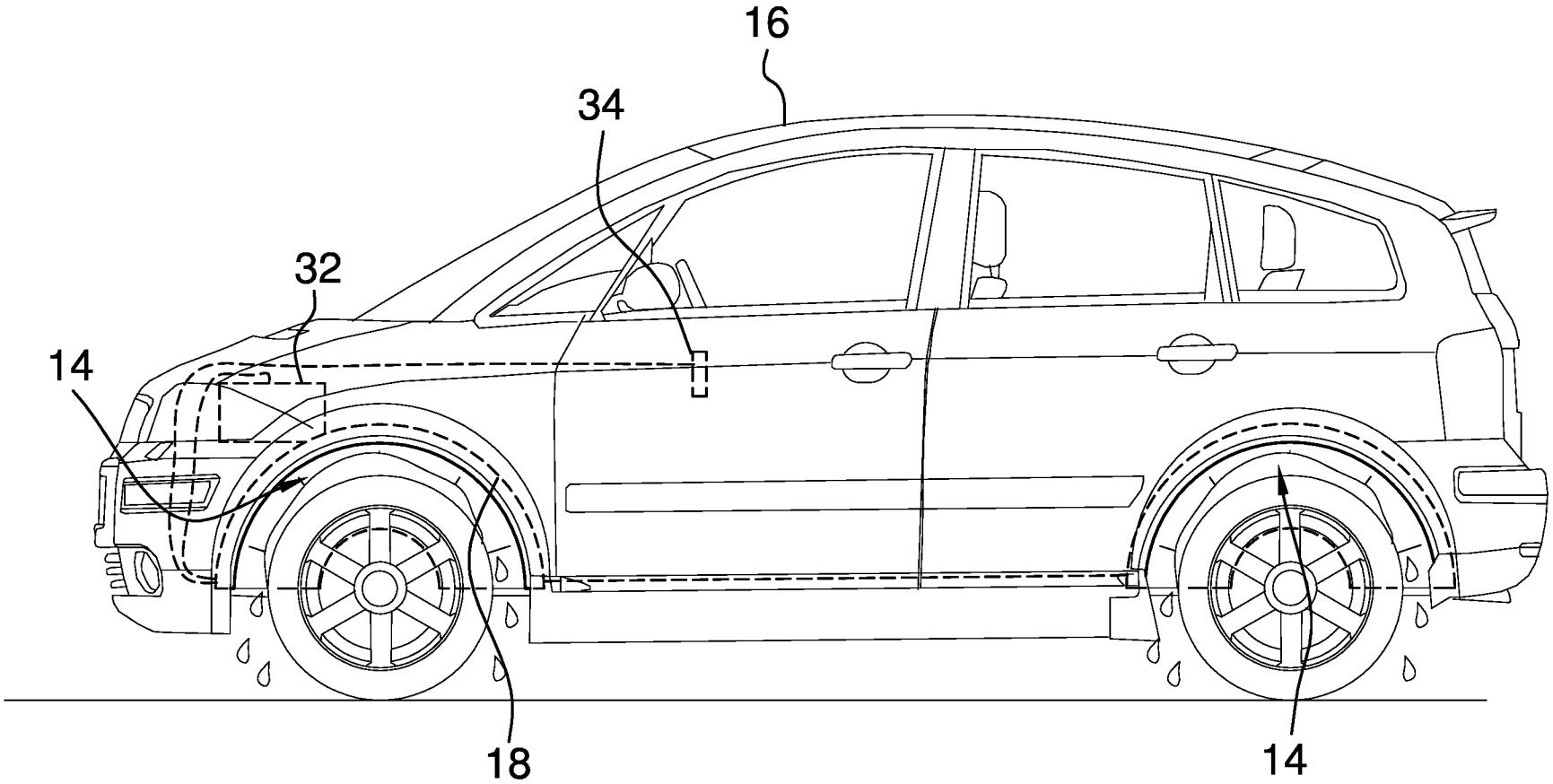
FIG. 4 is a phantom in-use view of an embodiment of the disclosure.
Figure 5:
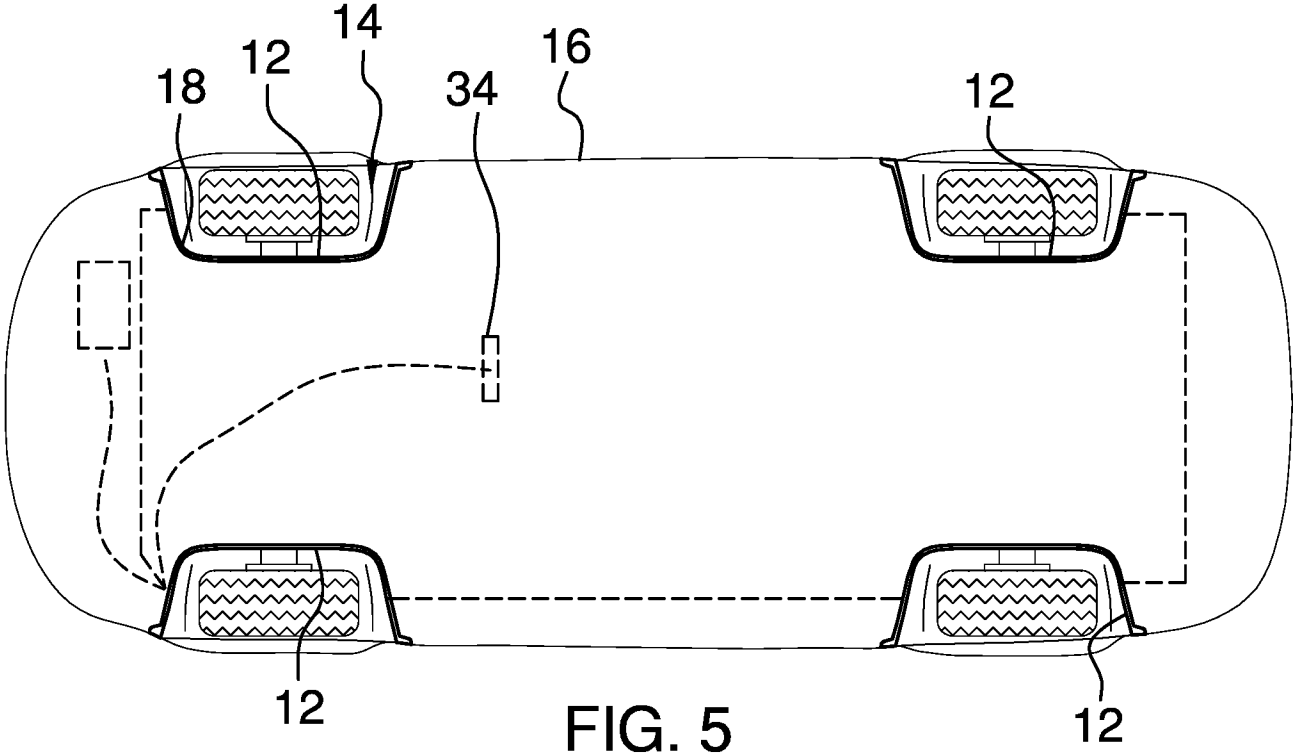
FIG. 5 is a bottom perspective in-use view of an embodiment of the disclosure.

With reference now to the drawings, and in particular to FIGS. 1 through 5 thereof, a new melting device embodying the principles and concepts of an embodiment of the disclosure and generally designated by the reference numeral 10 will be described.

As best illustrated in FIGS. 1 through 5, the ice melting assembly 10 generally comprises a liner 12 that is selectively mounted in a wheel well 14 of a vehicle 16 having the liner 12 being coextensive with a bounding surface 18 of the wheel well 14. The vehicle 16 may be a passenger vehicle, a cargo vehicle and any other closed wheel vehicle. The liner 12 has a first end 20, a second end 22 and a first surface 24 extending therebetween, and the first surface 24 has a first edge 26 and a second edge 27.

The liner 12 is elongated between the first end 20 and the second end 22. Moreover, the liner 12 is concavely arcuate between the first end 20 and the second end 22 to follow a curve of the wheel well 14. The first surface may slope upwardly between the first edge and the second edge 27. The liner 12 is comprised of a thermally conductive material and a lip 28 is coupled to and extends upwardly from the first surface 24. The lip 28 is coextensive with the first edge 26 and the lip 28 abuts an outer surface of the vehicle 16 when the liner 12 is positioned in the wheel well 14. Moreover, the liner 12 may be coupled to the bounding surface 18 of the wheel well 14 with a plurality of fasteners, such as bolts or the like.

A heating element 30 is positioned within the liner 12 and the heating element 30 is in thermal communication with the liner 12. The heating element 30 is electrically coupled to the vehicle's electrical system 32 via a conductor or the like. Moreover, the heating element 30 heats the liner 12 when the heating element 30 is turned on to inhibit ice from forming on the liner 12. The heating element 30 comprises a plurality of coils 31 and each of the coils 31 extends substantially between the first end 20 and the second end 22. The heating element 30 may be an electrical heating element 30 or the like and the heating element 30 may have an operational temperature ranging between approximately 60.0 degrees Fahrenheit and 80.0 degrees Fahrenheit.

A control 34 is provided and the control 34 is manipulated. The control 34 is electrically coupled to the heating element 30 to turn the heating element 30 on and off. The control 34 comprises a housing 36 that is positioned in the vehicle 16 such that the housing 36 is accessible to a driver of the vehicle 16. A switch 38 is slidably coupled to the housing 36 and the switch 38 is selectively manipulated. The switch 38 is selectively positioned between a low position, a medium position and a high position.

The switch 38 is electrically coupled to the heating element 30 via a conductor or the like. The heating element 30 heats the liner 12 to a minimum temperature when the switch 38 is positioned in the low position. The heating element 30 heats the liner 12 to a medial temperature when the switch 38 is positioned in the medium position. Finally, the heating element 30 heats the liner 12 to a maximum temperature when the switch 38 is positioned in the high position.

A plurality of the liners 12 is provided and each of the plurality of liners 12 is positioned in an associated one of a plurality of wheel wells 14 on the vehicle 16. The heating element 30 corresponding to each of the plurality of liners 12 is each electrically coupled to the vehicle 16. Additionally, the control 34 is electrically coupled to the heating element 30 corresponding to each of the plurality of liners 12. Thus, the control 34 controls operational parameters of the heating element 30 in each of the plurality of liners 12.

In use, each of the liners 12 is positioned in the corresponding wheel well 14 and the switch 38 is selectively manipulated when the vehicle 16 is being driven in winter conditions. The heating element 30 corresponding to each of the liners 12 is turned on to heat the corresponding liner 12. In this way ice and snow are inhibited from collecting on the liner 12. Thus, each of the wheel wells 14 is kept clear of snow and ice when the vehicle 16 is being driven in winter conditions. Each of the liners 12 is selectively cleaned at any time to remove dirt and debris that have collected on the liners 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ice melting assembly being configured to be mounted in a wheel well of a vehicle thereby inhibiting ice from forming in the wheel well, said assembly comprising:

a liner being configured to be mounted in the wheel well of the vehicle having said liner being coextensive with a bounding surface of the wheel well, said liner having a first end, a second end and a first surface extending therebetween, said first surface having a first edge, said liner being elongated between said first end and said second end, said liner being concavely arcuate between said first end and said second end wherein said liner is configured to follow a curve of the wheel well, said liner having a lip being coupled to said first surface, said lip being coextensive with said first edge wherein said lip is configured to abut an outer surface of the vehicle when said liner is positioned in the wheel well;

a heating element being positioned within said liner such that said heating element is in thermal communication with said liner wherein said heating element is configured to inhibit ice and snow from accumulating on said liner when said heating element is turned on; and a control being configured to be manipulated, said control being electrically coupled to said heating element to turn said heating element on and off, said control comprising a housing being configured to be positioned in the vehicle, and a switch being slidably coupled to said housing wherein said switch is configured to be manipulated, said switch being selectively positioned between a low position, a medium position and a high position, said switch being electrically coupled to said heating element.

2. The assembly according to claim 1, wherein said liner is comprised of a thermally conductive material.

3. The assembly according to claim 1, wherein said heating element is configured to be electrically coupled to an electrical system of the vehicle, said heating element heating said liner when said heating element is turned on wherein said heating element is configured to inhibit ice from forming on said liner, said heating element comprising a plurality of coils, each of said coils extending between said first end and said second end.

4. The assembly according to claim 1, wherein said heating element heats said liner to a minimum temperature when said switch is positioned in said low position, said heating element heating said liner to a medial temperature when said switch is positioned in said medium position, said heating element heating said liner to a maximum temperature when said switch is positioned in said high position.

5. An ice melting assembly being configured to be mounted in a wheel well of a vehicle thereby inhibiting ice from forming in the wheel well, said assembly comprising:

a liner being configured to be mounted in the wheel well of the vehicle having said liner being coextensive with a bounding surface of the wheel well, said liner having a first end, a second end and a first surface extending therebetween, said first surface having a first edge, said liner being elongated between said first end and said second end, said liner being concavely arcuate between said first end and said second end wherein said liner is configured to follow a curve of the wheel well, said liner being comprised of a thermally conductive material, said liner having a lip being coupled to said first surface, said lip being coextensive with said first edge wherein said lip is configured to abut an outer surface of the vehicle when said liner is positioned in the wheel well;

a heating element being positioned within said liner such that said heating element is in thermal communication with said liner wherein said heating element is configured to inhibit ice and snow from accumulating on said liner when said heating element is turned on, said heating element being configured to be electrically coupled to the vehicle's electrical system, said heating element heating said liner when said heating element is turned on wherein said heating element is configured to inhibit ice from forming on said liner, said heating element comprising a plurality of coils, each of said coils extending between said first end and said second end; and a control being configured to be manipulated, said control being electrically coupled to said heating element to turn said heating element on and off, said control comprising:

a housing being configured to be positioned in the vehicle, and a switch being slidably coupled to said housing wherein said switch is configured to be manipulated, said switch being selectively positioned between a low position, a medium position and a high position, said switch being electrically coupled to said heating element, said heating element heating said liner to a minimum temperature when said switch is positioned in said low position, said heating element heating said liner to a medial temperature when said switch is positioned in said medium position, said heating element heating said liner to a maximum temperature when said switch is positioned in said high position.

* * * * *